US008646364B2

(12) United States Patent
Kang

(10) Patent No.: US 8,646,364 B2
(45) Date of Patent: Feb. 11, 2014

(54) TOOL FOR ASSEMBLING AND DISASSEMBLING THE FRONT AND THE REAR WHEEL AXLE OF A MOTORCYCLE

(75) Inventor: Hsin-Fa Kang, Tainan (TW)

(73) Assignee: Jui-Deng Industrial Corp., Tainan (TW)

( * ) Notice: Subject to any disclaimer, the term of this patent is extended or adjusted under 35 U.S.C. 154(b) by 334 days.

(21) Appl. No.: 13/052,104

(22) Filed: Mar. 20, 2011

(65) Prior Publication Data

US 2012/0234141 A1 Sep. 20, 2012

(51) Int. Cl.
*B25B 13/06* (2006.01)

(52) U.S. Cl.
USPC ..... 81/121.1; 81/119; 81/120

(58) Field of Classification Search
USPC ..... 81/119, 120, 121.1
See application file for complete search history.

(56) References Cited

U.S. PATENT DOCUMENTS 4,328,720 A * 5/1982 Shiel ..... 81/63
7,454,998 B1 * 11/2008 Hsieh ..... 81/185
2009/0064825 A1 * 3/2009 Milligan et al. ..... 81/121.1

* cited by examiner

*Primary Examiner* — Lee D Wilson
*Assistant Examiner* — Shantese McDonald

(57) ABSTRACT

A tool for assembling and disassembling the front and the rear wheel axle of a motorcycle includes a nut holding base having one side formed with a ratchet recessed groove provided therein with a projecting member having a hexagonal recessed groove formed in the interior. The nut holding base has another side provided with an extension projecting post having an interior bored with a square hole communicating with the hexagonal recessed groove. A connecting holder to be assembled on the nut holding base has one side formed with a hexagonal projecting connector matching with the hexagonal recessed groove of the nut holding base and having an interior disposed with a square insert hole. The connecting holder has another side formed with a hexagonal recessed groove provided with a projecting member bored in therein with an insert hole that communicates with the square insert hole.

4 Claims, 13 Drawing Sheets

TOOL FOR ASSEMBLING AND DISASSEMBLING THE FRONT AND THE REAR WHEEL AXLE OF A MOTORCYCLE

BACKGROUND OF THE INVENTION

1. Field of the Invention

This invention relates to a tool for assembling and disassembling the front and the rear wheel axle of a motorcycle, particularly to one able to match different-sized wheel axles of the front and the rear wheel of a motorcycle, facilitating assembly and disassembly of the wheel axles and reducing expenses on purchasing tools.

2. Description of the Prior Art

Generally, the front wheel axle of a motorcycle is threadably locked on the front wheel 10 mostly by means of two different-sized hexagonal nuts 100 (28 mm and 30 mm), referring to FIG. 1, while the rear wheel axle is threadably locked on the rear wheel 11 mostly by a ratchet nut 110, referring to FIG. 2. And, a nut holding base 2 and a spanner 3 cooperating with each other must be used for carrying out assembly and disassembly of the hexagonal nut 100 and the ratchet nut 110 of the front and the rear wheel axle of a motorcycle. A conventional nut holding base 2 has one side formed with a ratchet recessed groove 20 fixed therein with a projecting member 21 protruding out of the side surface of the nut holding base 2. The projecting member 21 has its outer end provided with a hexagonal recessed groove 22 secured therein with a projecting post 23 having its interior bored with a square insert hole 24 that passes through another side surface of the nut holding base 2. To assemble or disassemble a front wheel axle, a nut holding base 2 (28 mm or 30 mm) with the same size of the hexagonal nut 100 of the front wheel axle has to be chosen for use first, and then the nut holding base 2 is mounted on the hexagonal nut 100 of the front wheel axle, letting the hexagonal recessed groove 22 at the outer end of the projecting member 21 of the nut holding base 2 fitted on the hexagonal nut 100 of the front wheel axle. Next, the square connecting block 30 of the spanner 3 is inserted in the square insert hole 24 of the nut holding base 2 and then, the spanner 3 is pulled to turn the nut holding base 2 to actuate the hexagonal nut 100 to rotate on the front wheel axle. Thus, the hexagonal nut 100 can be disassembled from or threadably locked on the front wheel axle. To assemble or disassemble a rear wheel axle, have the nut holding base 2 engaged with the ratchet nut 110 of the rear wheel axle, letting the ratchet recessed groove 20 of the nut holding base 2 fitted on the ratchet nut 110 of the rear wheel axle and then, have the square connecting block 30 of the spanner 3 inserted in the square insert hole 24 of the nut holding base 2. Subsequently, the spanner 3 is forcefully pulled to turn the nut holding base 2 and actuate the ratchet nut 110 to rotate on the rear wheel axle and thus, the ratchet nut 110 can be disassembled from or screwed on the rear wheel axle. However, the conventional nut holding base 2 can be only applied to a single size of a hexagonal nut 100 (28 mm or 30 mm); therefore, in order to assemble or disassemble two different-sized hexagonal nuts 100 of the front wheel axles, two different-sized nut holding bases 2 shall be bought for use, thus inconvenient in use and spending extra costs on buying tools.

SUMMARY OF THE INVENTION

The objective of this invention is to offer a tool for assembling and disassembling the front and the rear wheel axle of a motorcycle, able to match different-sized wheel axles of the front and the rear wheel of a motorcycle, convenient in assembling and disassembling wheel axles and cutting down expense on buying tools.

The tool for assembling and disassembling the front and the rear wheel axle of a motorcycle in the present invention includes a nut holding base having one side provided with a ratchet recessed groove formed therein with a projecting member that is bored with a hexagonal recessed groove in the interior.

The feature of this invention is that the nut holding base has another side formed with an extension projecting post bored in the interior with a square hole communicating with the hexagonal recessed groove. A connecting holder to be assembled on the nut holding base has one side provided with a hexagonal projecting connector matching with the hexagonal recessed groove of the nut holding base and having an interior disposed with a square insert hole. The connecting holder has another side provided with a hexagonal recessed groove formed therein with a projecting member bored in the interior with an insert hole communicating with the square insert hole of the projecting connector.

The end of the projecting member in the ratchet recessed groove of the nut holding base of this invention does not protrude out of the side surface of the nut holding base.

The projecting connector of the connecting holder of this invention is provided with an annular groove fixed therein with an anti-skid washer The hexagonal recessed groove of the connecting holder is larger in size than the hexagonal recessed groove of the nut holding base, so that two different-sized nuts on the front wheel axles can be assembled and disassembled.

The nut holding base and the connecting holder provided in this invention can be matched with each other for assembling and disassembling different-sized hexagonal nuts on the front wheel axles and the ratchet nut on the rear wheel axle, convenient in using and carrying about and able to reduce costs on buying tools for assembling and disassembling.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
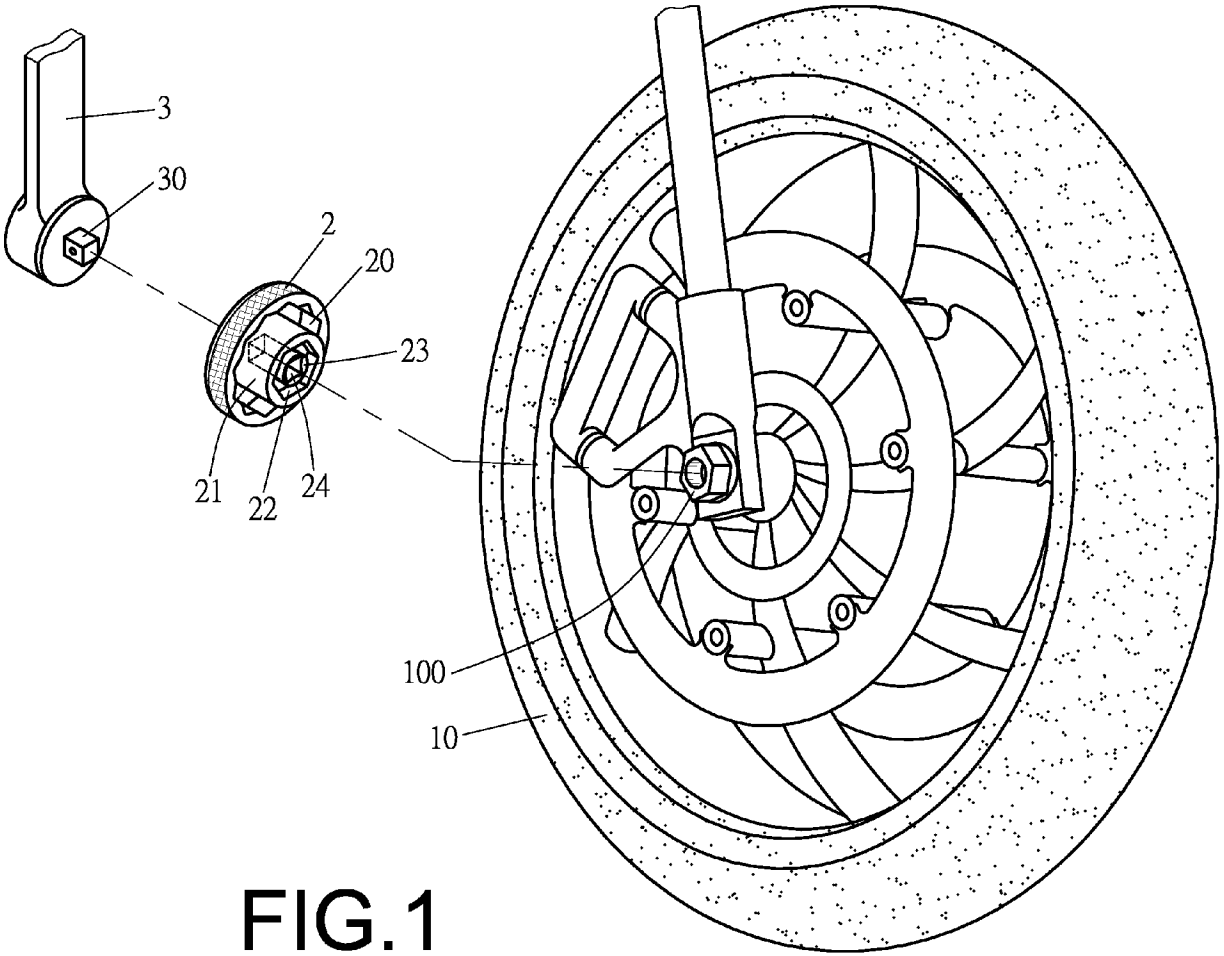
FIG.1 (PRIOR ART)
FIG. 1 is a schematic view of a conventional tool for assembling and disassembling the front wheel axle of a motorcycle.
Figure 2:
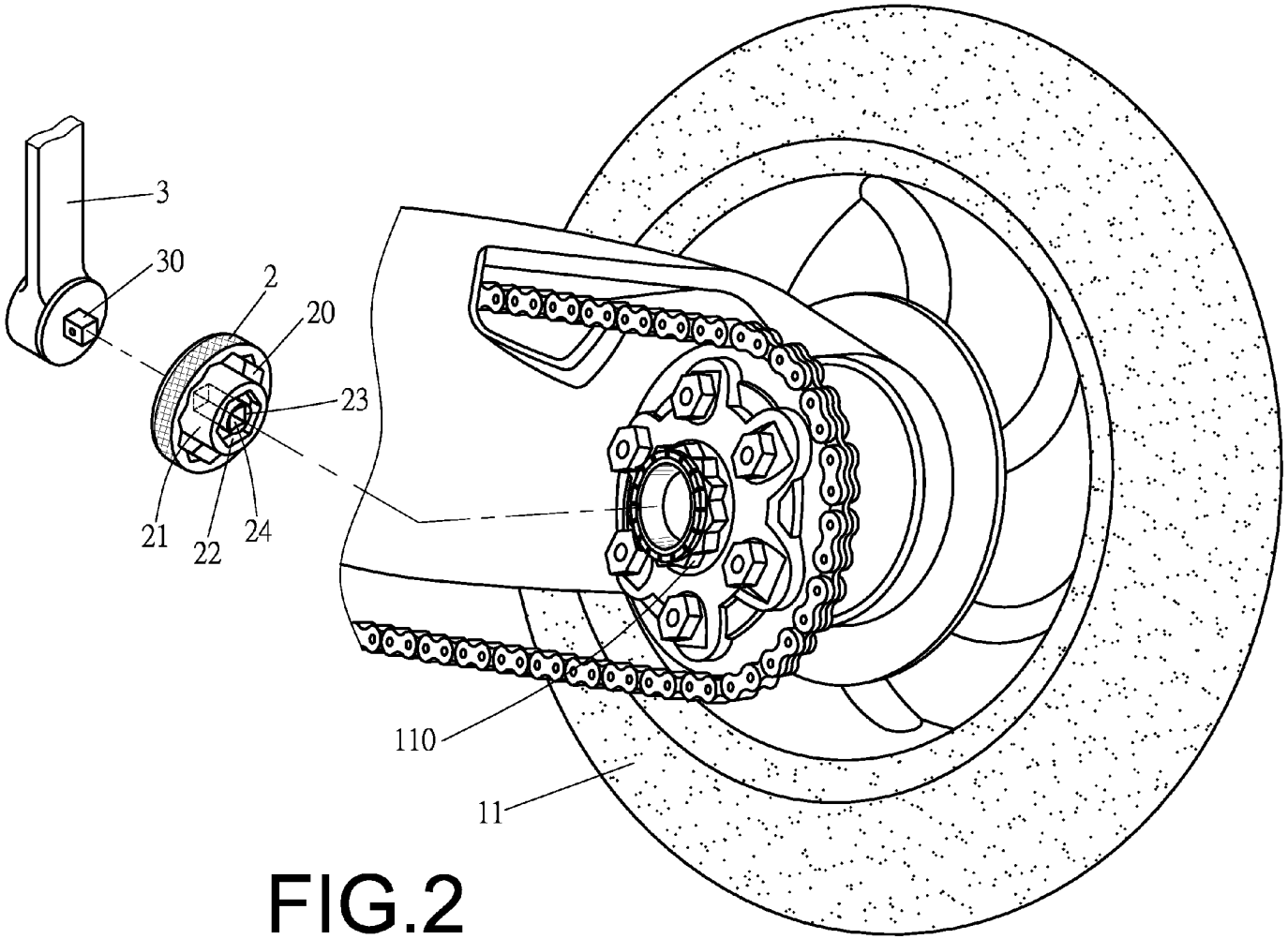
FIG.2 (PRIOR ART)
FIG. 2 is a schematic view of a conventional tool for assembling and disassembling the rear wheel axle of a motorcycle.
Figure 3:
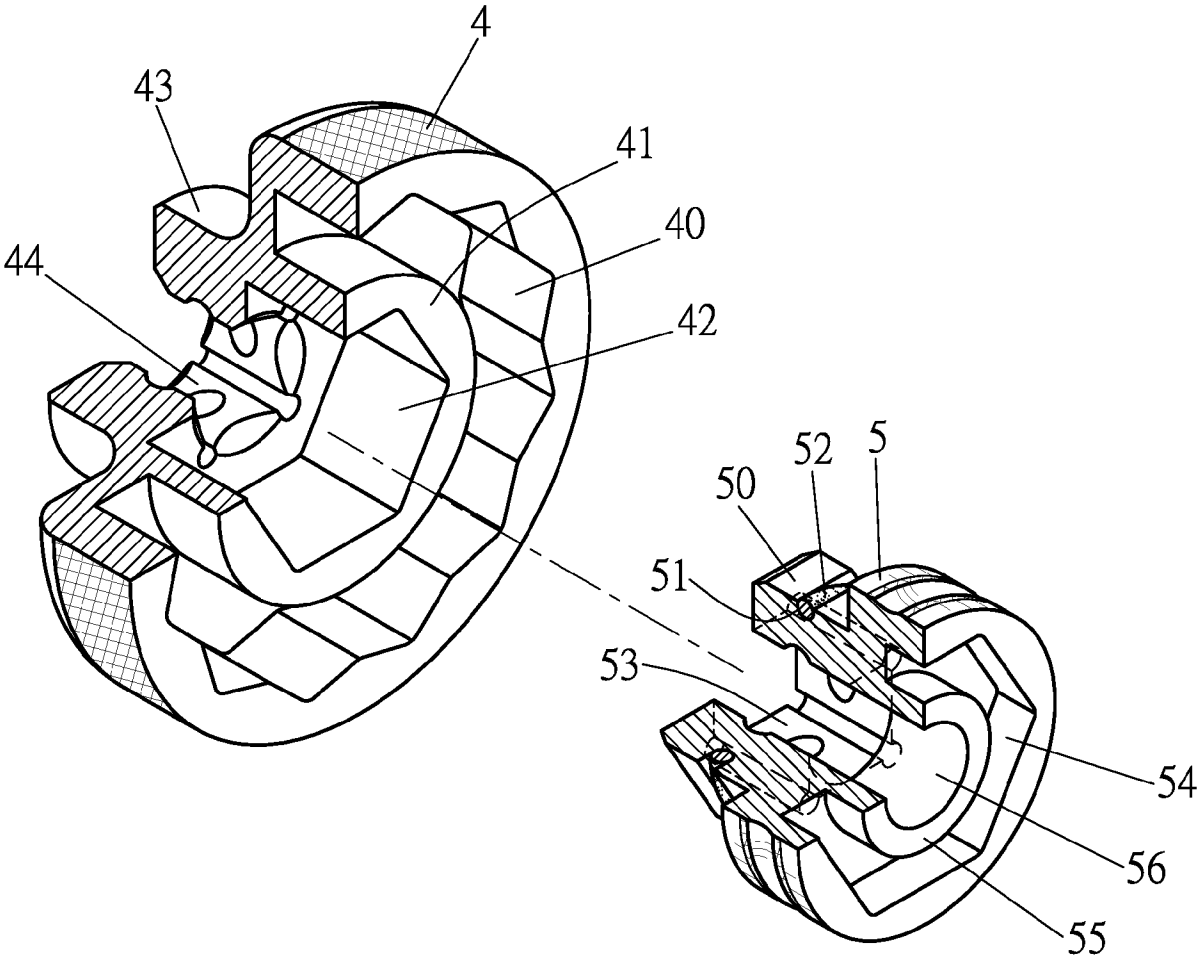
FIG. 3 is an exploded perspective view of a tool for assembling and disassembling the front and the rear wheel axle of a motorcycle in the present invention.
Figure 4:
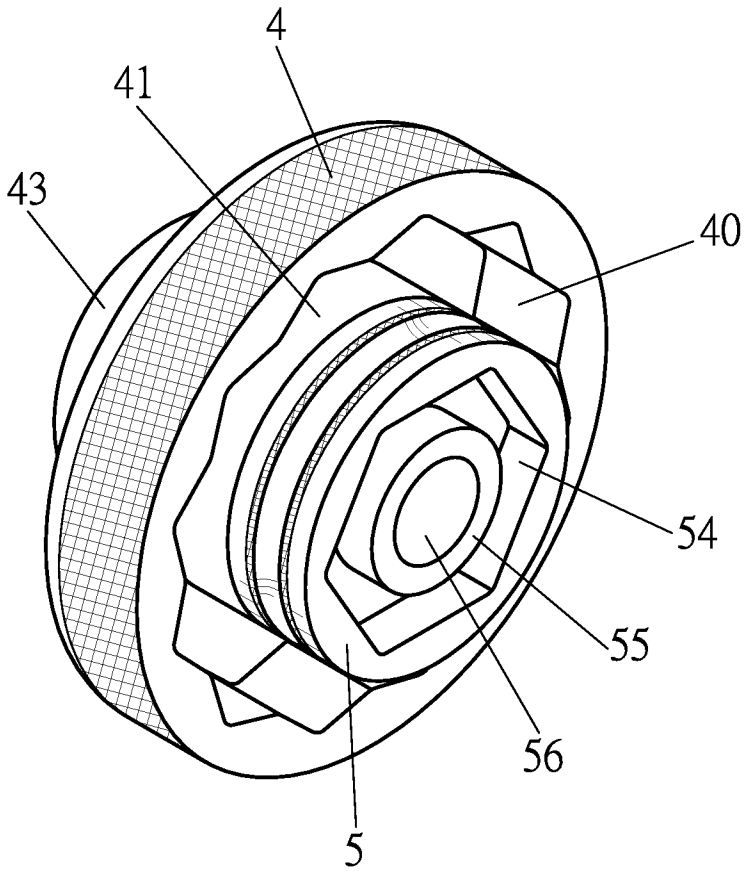
FIG. 4 is a perspective view of the tool for assembling and disassembling the front and the rear wheel axle of a motorcycle in the present invention.
Figure 5:
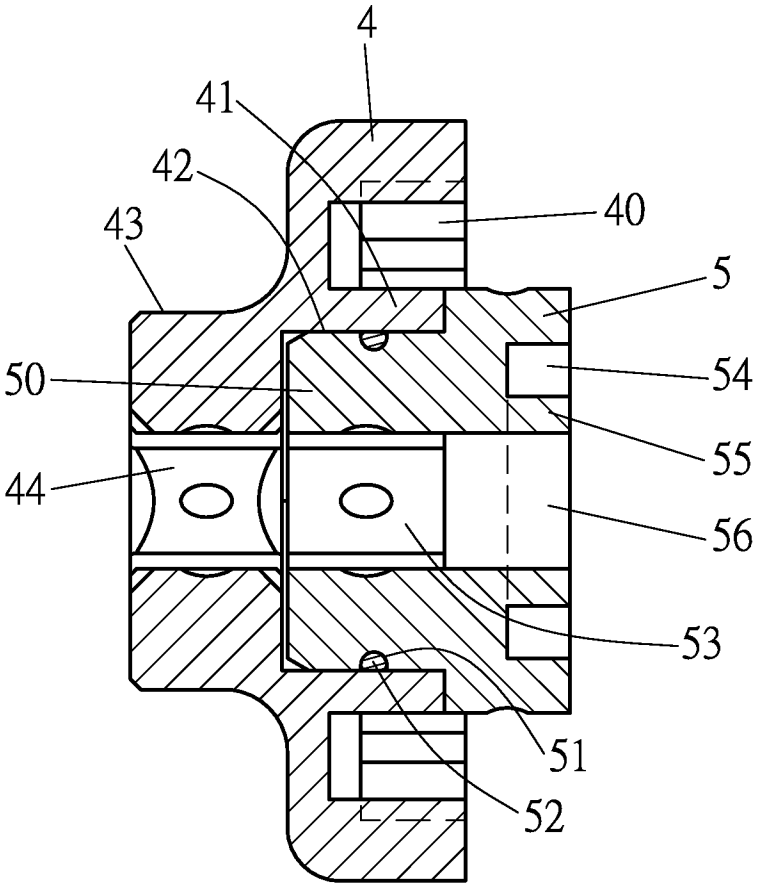
FIG. 5 is a cross-sectional view of the tool for assembling and disassembling the front and the rear wheel axle of a motorcycle in the present invention.

A preferred embodiment of a tool for assembling and disassembling the front and the rear wheel axle of a motorcycle in the present invention, as shown in FIGS. 3, 4 and 5, includes a nut holding base 4 and connecting holder 5 as main components combined together.

The nut holding base 4 has one side provided with a ratchet recessed groove 40 fixed therein with a projecting member 41 whose end does not protrude out of the side surface of the nut holding base 4 and whose interior is disposed with a hexagonal recessed groove 42. The nut holding base 4 has another side formed with an extension projecting post 43 bored with a square hole 44 communicating with the hexagonal recessed groove 42.

The connecting holder 5 to be assembled on the nut holding base 4 has one side provided with a hexagonal projecting connector 50 for matching exactly the hexagonal recessed groove 42 of the nut holding base 4. The hexagonal projecting connector 50 is cut with an annular groove 51 having an anti-slipping washer 52 fixed therein and is bored with a square hole 53 in the interior. The connecting holder 5 has another side formed with a hexagonal recessed groove 54, which is larger than the hexagonal recessed groove 42 of the nut holding base 4 and has its interior formed with a projecting member 55 bored therein with an insert hole 56 to communicate with the square hole 53 in the projecting connector 50. Thus, a tool for assembling and disassembling the front and the rear wheel axle of a motorcycle is formed.

Figure 6:
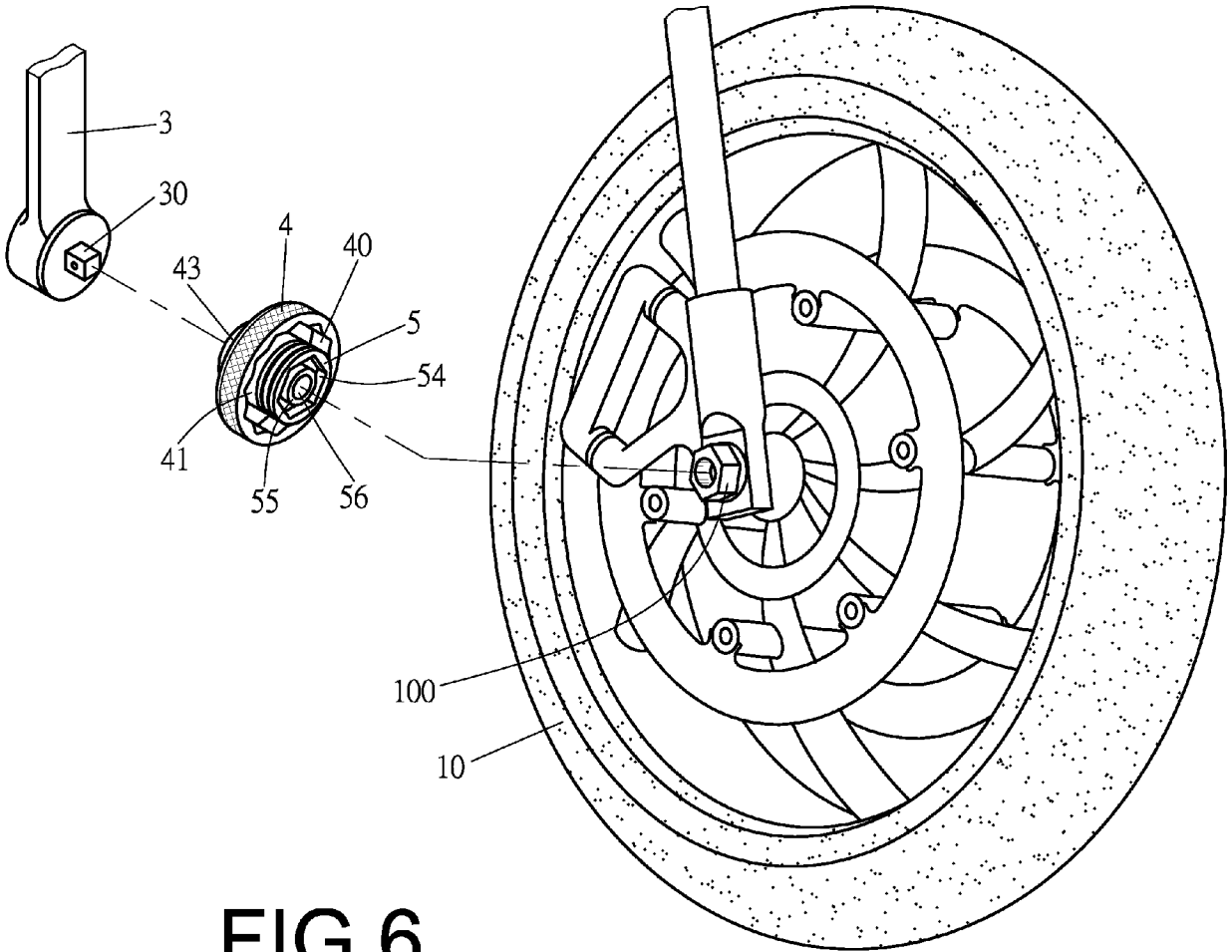
FIG. 6 is an exploded perspective view of the tool in the present invention and a perspective view of the front wheel of a motorcycle.
Figure 7:
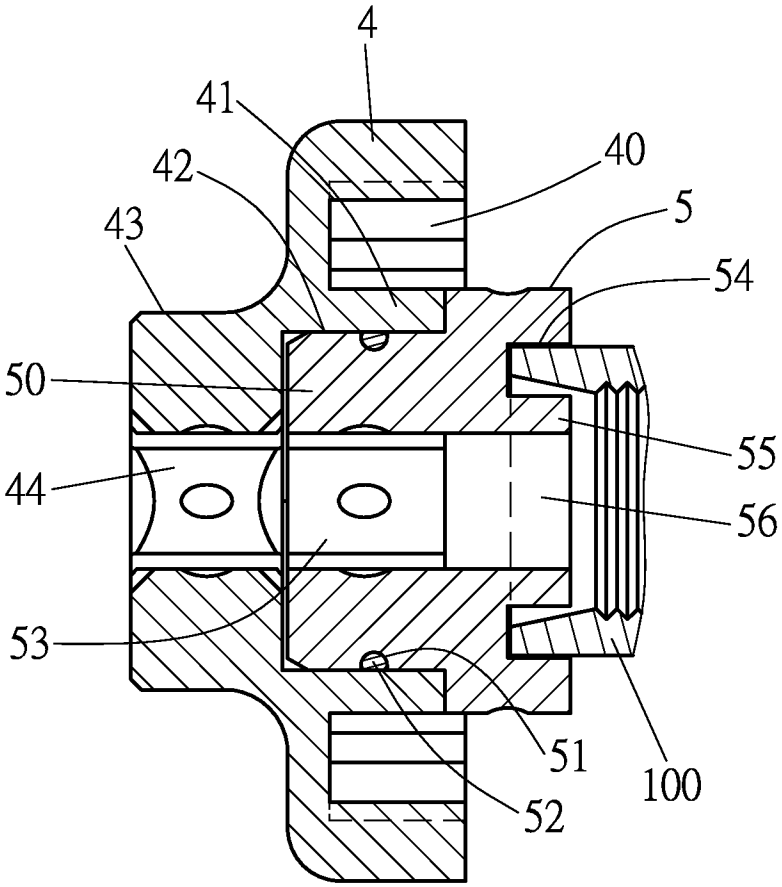
FIG. 7 is a cross-sectional view of the tool in the present invention, which is fitted on the hexagonal nut of the front wheel axle of a motorcycle.
Figure 8:
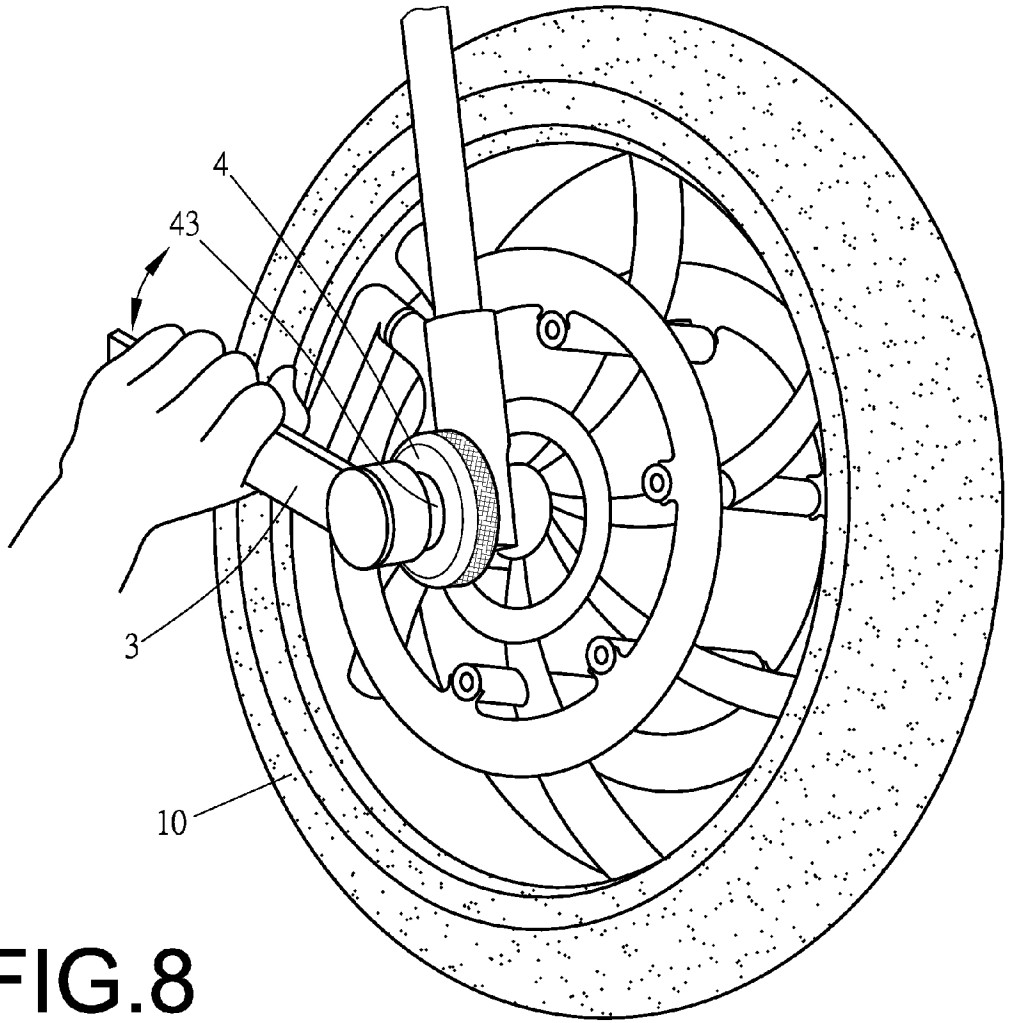
FIG. 8 is a schematic view showing that a spanner is inserted in a square insert hole of a nut holding base and pulled to turn the nut holding base in the present invention.

To assemble or disassemble the front wheel axle of a motorcycle, referring to FIGS. 6, 7 and 8, if the size of hexagonal nut 100 on the front wheel axle is a large one (30 mm), the connecting holder 5 will be firstly assembled on the nut holding base 4 to have the hexagonal projecting connector 50 of the connecting holder 5 engaged in the hexagonal recessed groove 42 of the nut holding base 4. Then, have the anti-slipping washer 52 on the projecting connector 50 closely stuck to the inner wall of the hexagonal recessed groove 42 of the nut holding base 4. Thus, the connecting holder 5 can be firmly positioned on the nut holding base 4 in order to prevent removing from the nut holding base 4. Next, the nut holding base 4 and the connecting holder 5 together are engaged with the hexagonal nut 100 of the front wheel axle, letting the hexagonal recessed groove 54 of the connecting holder 5 fitted on the hexagonal nut 100 of the front wheel axle. Subsequently, have the square connecting block 30 of the spanner 3 inserted in the square insert hole 44 of the nut holding base 4 and then apply force to pull the spanner 3 to turn the nut holding base 4 and the connecting holder 5 and actuate the hexagonal nut 100 to rotate on the front wheel axle, thus enabling the hexagonal nut 100 disassembled from or screwed on the front wheel axle.

Figure 9:
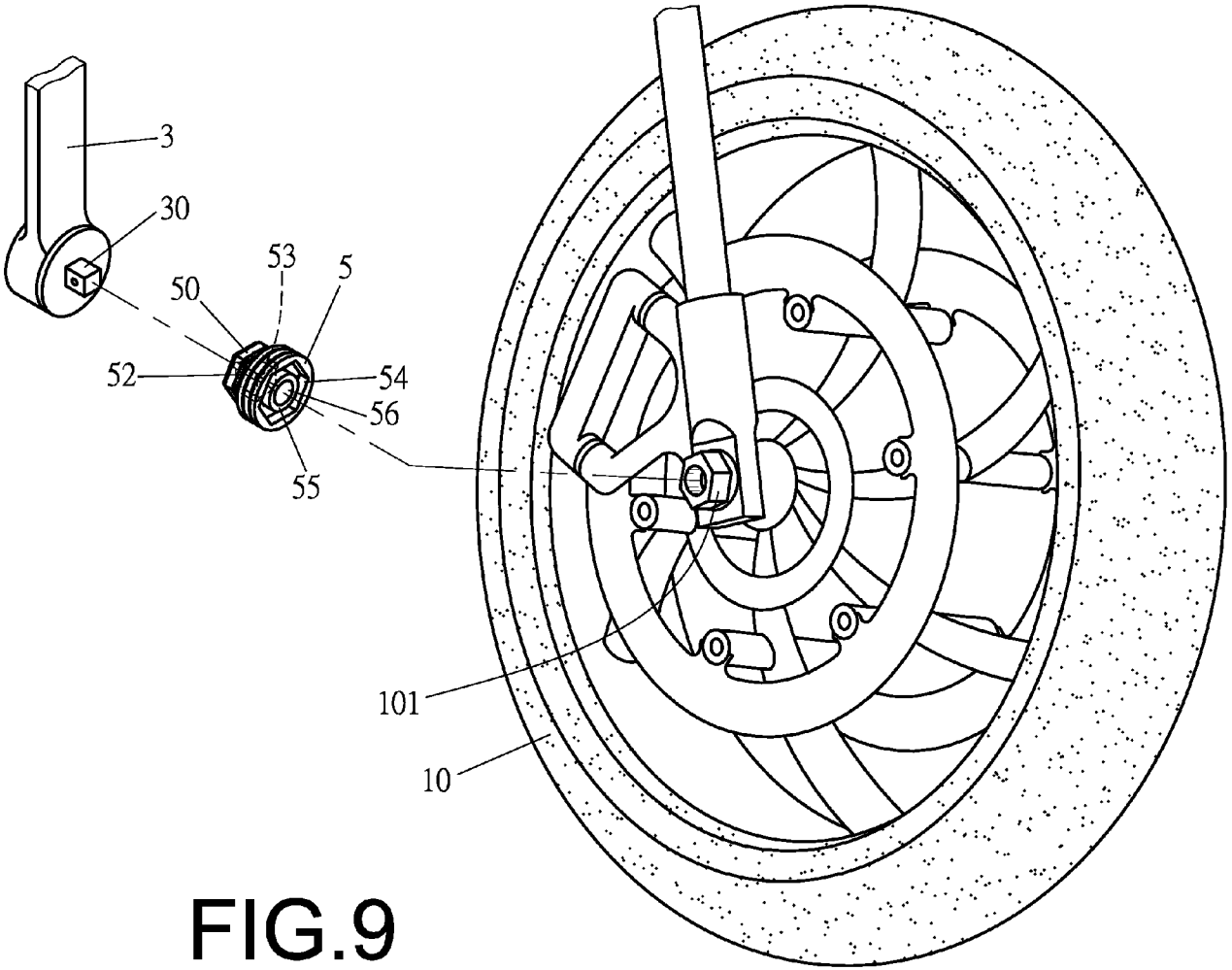
FIG. 9 is a schematic view of a connecting holder in the present invention and the front wheel of a motorcycle.

In this invention, the connecting holder 5 can be singly and directly fitted on the hexagonal nut 100 of the front wheel axle, as shown in FIG. 9, and the square connecting block 30 of the spanner 3 can be directly inserted in the square insert hole 53 in the projecting connector 50 and then, pull the spanner 3 to actuate the hexagonal nut 100 to rotate for carrying out disassembly or assembly of the hexagonal nut 100 of the front wheel axle.

Figure 10:
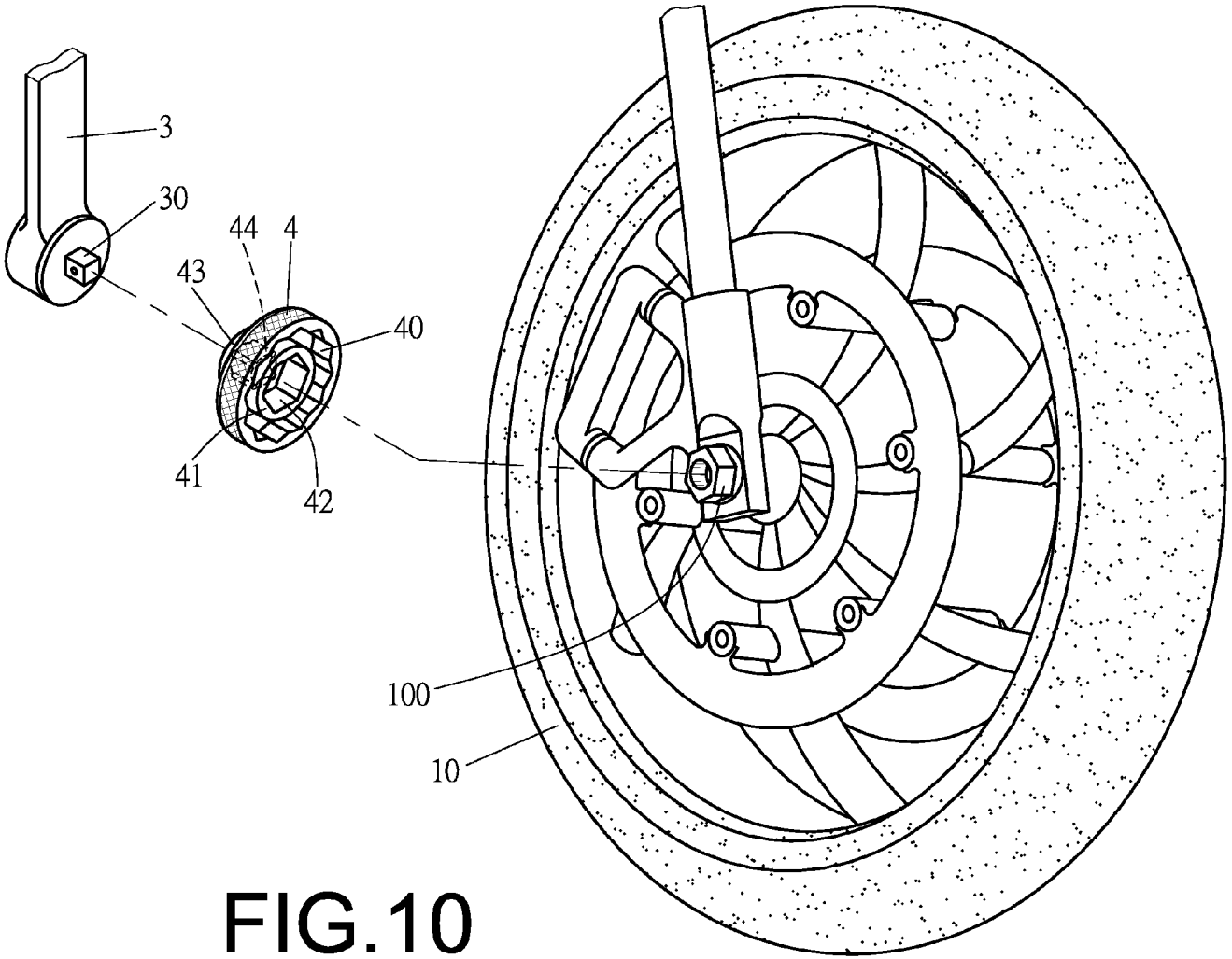
FIG. 10 a schematic view of the tool in the present invention and a perspective view of a different-sized front wheel of a motorcycle.
Figure 11:
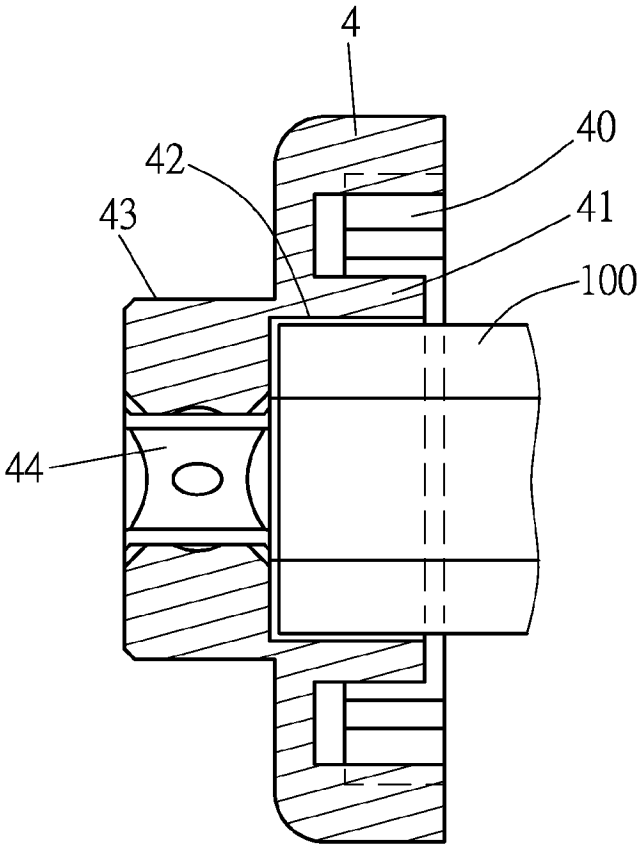
FIG. 11 is a cross-sectional view of the tool in the present invention, which is fitted on another-sized hexagonal nut on the front wheel axle of a motorcycle.

If the hexagonal nut 101 of the front wheel axle is of a small size (28 mm), referring to FIGS. 10 and 11, firstly, remove the connecting holder 5 from the nut holding base 4 and fit the nut holding base 4 on the hexagonal nut 101 of the front wheel axle, letting the hexagonal recessed groove 42 of the nut holding base 4 fitted on the hexagonal nut 101 of the front wheel axle. Next, insert the square connecting block 30 of the spanner 3 in the square hole 44 of the nut holding base 4 and then, apply force to pull the spanner 3 to turn the nut holding base 4 and actuate the hexagonal nut 101 to rotate on the front wheel axle. Thus, the hexagonal nut 101 can be disassembled from or firmly screwed on the front wheel axle.

Figure 12:
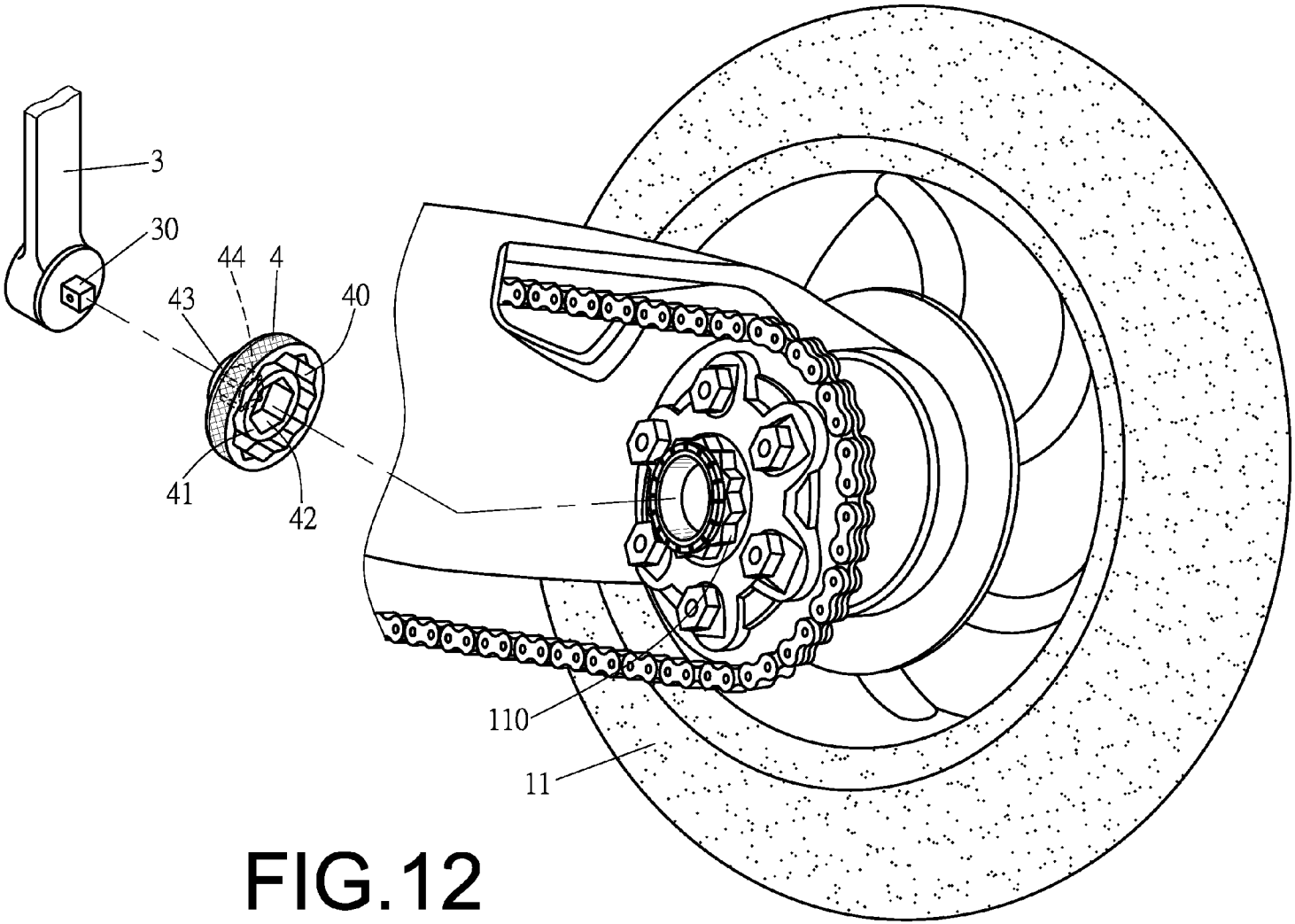
FIG. 12 is a schematic view of the tool in the present invention to be fitted on the rear wheel axle of a motorcycle.
Figure 13:
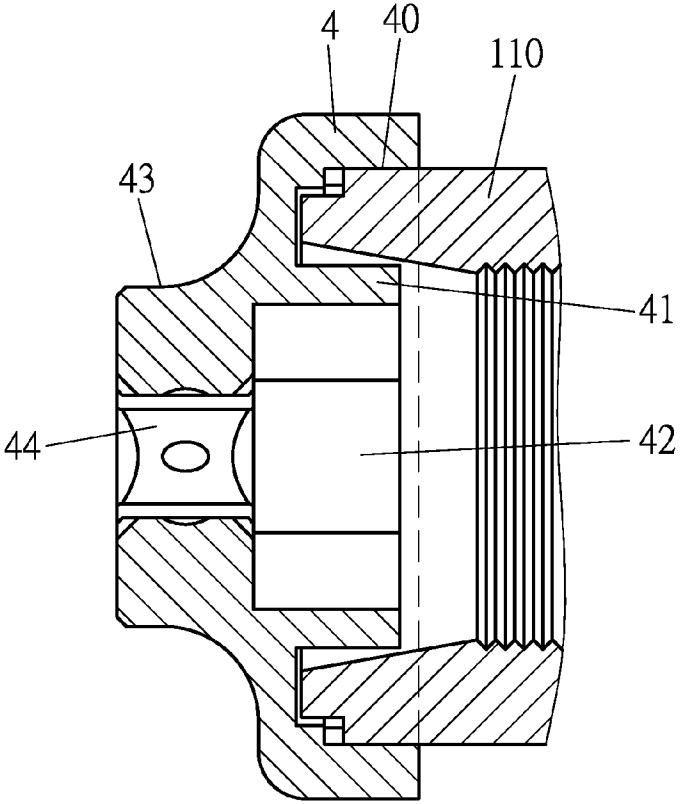
FIG. 13 is a cross-sectional view illustrating that the tool in the present invention is fitted on the hexagonal nut on the rear wheel axle of a motorcycle.

To assemble or disassemble the rear wheel axle, referring to FIGS. 12 and 13, firstly, remove the connecting holder 5 from the nut holding base 4 and then have the nut holding base 4 engaged with the ratchet nut 110 of the rear wheel axle, letting the ratchet recessed groove 40 of the nut holding base 4 fitted on the ratchet nut 110 of the rear wheel axle. Afterward, insert the square connecting block 30 of the spanner 3 in the square hole 44 of the nut holding base 4 and apply force to turn the spanner together with the nut holding base 4 to actuate the ratchet nut 110 to rotate on the rear wheel axle, thus enabling the ratchet nut 110 disassembled from or threadably locked on the rear wheel axle.

Apparently, the nut holding base 4 and the connecting holder 5 provided in this invention can be coupled with each other for disassembling or assembling different-sized hexagonal nuts 100, 101 on a front wheel axle and the ratchet nut 110 on a rear wheel axle, able to be used and carried about conveniently and reducing expense on buying assembling and disassembling tools.

While the preferred embodiment of the invention has been described above, it will be recognized and understood that various modifications may be made therein and the appended claims are intended to cover all such modifications that may fall within the spirit and scope of the invention.

What is claimed is:

1. A tool for assembling and disassembling the front and the rear wheel axle of a motorcycle comprising a nut holding base, said nut holding base having one side provided with a ratchet recessed groove, said ratchet recessed groove fixed therein with a first projecting member, said first projecting member bored with a hexagonal recessed groove in the interior; and, an extension projecting post formed at another side of said nut holding base, said extension projecting post having an interior provided with a square hole communicating with said hexagonal recessed groove, a connecting holder to be assembled on said nut holding base, said connecting holder having one side formed with a hexagonal projecting connector protruding outward, said hexagonal projecting connector matching exactly with said hexagonal recessed groove of said nut holding base, said projecting connector having an interior disposed with a square hole, said connecting holder having another side formed with a hexagonal recessed groove having a second projecting member set therein, said second projecting member having an interior bored with an insert hole communicating with said square hole in said projecting connector.

2. A tool for assembling and disassembling the front and the rear wheel axle of a motorcycle as claimed in claim 1, wherein an end of said first projecting member in said ratchet recessed groove of said nut holding base does not protrude out of a side surface of said nut holding base.

3. A tool for assembling and disassembling the front and the rear wheel axle of a motorcycle as claimed in claim 1, wherein said second projecting connector of said connecting holder is provided with an annular groove, said annular groove fixed therein with an anti-skid washer.

4. A tool for assembling and disassembling the front and the rear wheel axle of a motorcycle as claimed in claim 1, wherein said hexagonal recessed groove of said connecting holder is larger in size than said hexagonal recessed groove of said nut holding base.

* * * * *